US010947941B2

(12) United States Patent
Schneider et al.

(10) Patent No.: US 10,947,941 B2
(45) Date of Patent: Mar. 16, 2021

(54) FUEL-INJECTION SYSTEM AND ASSEMBLY THEREFOR

(71) Applicant: Robert Bosch GmbH, Stuttgart (DE)

(72) Inventors: Daniel Schneider, Ludwigsburg (DE); Heiko Gruschwitz, Sersheim (DE); Herbert Blob, Nuremberg (DE); Ingo Rettig, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/314,711

(22) PCT Filed: May 11, 2017

(86) PCT No.: PCT/EP2017/061359

§ 371 (c)(1),
(2) Date: Jan. 2, 2019

(87) PCT Pub. No.: WO2018/010870

PCT Pub. Date: Jan. 18, 2018

(65) Prior Publication Data

US 2019/0249633 A1 Aug. 15, 2019

(30) Foreign Application Priority Data

Jul. 15, 2016 (DE) ..... 10 2016 212 936.8

(51) Int. Cl.
*F02M 55/00* (2006.01)
*F02M 61/14* (2006.01)
(Continued)

(52) U.S. Cl.
CPC ..... *F02M 55/005* (2013.01); *F02M 55/025* (2013.01); *F02M 61/14* (2013.01);
(Continued)

(58) Field of Classification Search
CPC .... F02M 55/005; F02M 55/025; F02M 55/02; F02M 2200/856; F02M 2200/8084;
(Continued)

(56) References Cited

U.S. PATENT DOCUMENTS

2002/0029762 A1* 3/2002 Scollard ..... F02M 55/004 123/456
2008/0216798 A1* 9/2008 Ghelardi ..... F02M 55/005 123/470
(Continued)

FOREIGN PATENT DOCUMENTS

CN 101793214 A 8/2010
CN 103890372 A 6/2014
(Continued)

OTHER PUBLICATIONS

International Search Report for PCT/EP2017/061359, dated Jul. 6, 2017.

*Primary Examiner* — George C Jin
(74) *Attorney, Agent, or Firm* — Norton Rose Fulbright US LLP; Gerard Messina

(57) ABSTRACT

An assembly for fuel-injection systems for connecting a fuel injector to a fuel-conveying component includes a retaining part that is used for mechanical fastening, and an attachment part, to which the fuel injector is hydraulically connectable. A connecting part is provided via which the attachment part, that is connectable to the fuel-conveying component, is connectable to the retaining part.

19 Claims, 3 Drawing Sheets

(51) Int. Cl.
*F02M 55/02* (2006.01)
*F02M 69/46* (2006.01)

(52) U.S. Cl.
CPC ... *F02M 69/465* (2013.01); *F02M 2200/8084* (2013.01); *F02M 2200/856* (2013.01); *F02M 2200/857* (2013.01)

(58) Field of Classification Search
CPC ..... F02M 2200/857; F02M 2200/803; F02M 61/14; F02M 61/168; F02M 69/465; F02M 69/50
See application file for complete search history.

(56) References Cited

U.S. PATENT DOCUMENTS

| | | | | |
|---|---|---|---|---|
| 2012/0138020 | A1* | 6/2012 | Kweon | F02M 55/025 123/469 |
| 2013/0276283 | A1* | 10/2013 | Han | F02M 37/00 29/417 |
| 2014/0326217 | A1* | 11/2014 | Roseborsky | F02M 69/50 123/456 |
| 2015/0369193 | A1 | 12/2015 | Harada | |
| 2017/0328321 | A1* | 11/2017 | Serra | F02M 61/145 |
| 2019/0111527 | A1* | 4/2019 | Serra | B23K 37/06 |
| 2019/0153986 | A1* | 5/2019 | Serra | F02M 55/025 |

FOREIGN PATENT DOCUMENTS

| | | | |
|---|---|---|---|
| CN | 104471236 | A | 3/2015 |
| EP | 2910768 | A1 | 8/2015 |
| WO | 2016079004 | A1 | 5/2016 |

* cited by examiner

FUEL-INJECTION SYSTEM AND ASSEMBLY THEREFOR

BACKGROUND INFORMATION

The present invention relates to an assembly for fuel-injection systems for connecting a fuel injector to a fuel-conveying component, and a fuel-injection system having at least one such assembly. In particular, the present invention relates to the field of fuel-injection systems for internal combustion engines.

U.S. Patent Application 2012/0138020 A1 describes a fastening assembly for a fuel rail to be used for direct injection. In the case of the known mounting, the manufacturing is carried out by casting.

Due to a cast design that is adapted to the application case, an assembly, as is described in U.S. Patent Application 2012/0138020 A1, makes possible a stress-optimized component design, but it constitutes a costly approach. This is also the case when the connection between the retaining part and the attachment part, in particular a valve cup is integrated into the two components.

SUMMARY

An example assembly according to the present invention and an example fuel-injection system according to the present invention may have the advantage of making possible an improved embodiment, which, in particular, permits an adequate stress optimization at low manufacturing costs.

The measures described herein make possible advantageous refinements of the system and of the fuel-injection system in accordance with the present invention.

The system and the fuel-injection system are especially suited for direct gasoline injection applications. In this case, the fuel-conveying component is preferably designed as a fuel distributor, in particular as a fuel manifold. First, such a fuel distributor may be used for distributing the fuel to a plurality of fuel injectors. The individual fuel injectors are then preferably connected to the fuel distributor via corresponding systems. During operation, the fuel injectors inject the fuel required for the combustion process at a high pressure into the respective combustion chamber of the internal combustion engine.

An example embodiment in accordance with the present invention may have the advantage of making possible a geometrically close placement of the attachment part on the fuel-conveying component, which, upon the occurrence of loads, results in short levers relative to bonding sites or bonding regions. The attachment part is preferably connected to the component by a material-to-material bond, in particular by brazing.

An example embodiment in accordance with the present invention may have the advantage of making a high mechanical stability attainable. Here, force may be introduced both from the attachment part, as well as from the retaining part directly into the component. The connecting part then leads to a further improvement with regard to the occurring mechanical stresses.

Generally, the connecting part may constitute a stiffening between the attachment part and the retaining part that prevents the stresses from becoming too great in the area of a connection, in particular of a brazed seam, between the attachment part and the component, respectively the retaining part and the component. The shape and configuration, as well as the position of the connecting part make it advantageously possible to ensure that the greatest mechanical stresses no longer occur at the bonding site, respectively bonding regions, in particular the brazed seam; rather, for example, that they be displaced into a radius of the connecting part. This enhances the strength of the overall design. The attachment part may, in particular, be designed as a valve cup. In particular, the retaining part may be configured as a retainer having a cylindrical recess.

In another possible embodiment according to the present invention, the need for the joining site between the retaining part and the component may be eliminated since the retaining part is connected to the attachment part via the connecting part.

An example embodiment in accordance with the present invention may have the advantage of making possible an inexpensive design of the retaining part.

In an embodiment of the connections, respectively of a connection between the retaining part and the component, respectively between the attachment part and the component, a brazing gap or the like may advantageously be rendered adjustable by using a brazed connection, for example, a redundancy in the determination of the connection(s) being avoided.

An example embodiment in accordance with the present invention may have the advantage of providing a high degree of mechanical stability and ease of mounting. It is especially advantageous here when the connecting part is made of a sheet-metal section. In particular, the connecting part may be formed here as a stiffening plate.

In a modified embodiment in accordance with the present invention, a plurality of sheet-metal sections may be used to form the connecting part. Joining methods, such as brazing, may be used here to connect the individual sheet-metal pieces.

An example embodiment in accordance with the present invention may make possible an advantageous design that avoids a redundancy in the determination.

Thus, an advantageous fuel-injection system may be realized. In this case, the fuel-conveying component may be a fuel distributor for direct injection of preferably gasoline, on which a plurality of retaining parts, a plurality of attachment parts, and a plurality of connecting parts are mounted, to realize hydraulic and mechanical connections to a cylinder head, for example, for the individual fuel injectors. The fuel-injection system must bear the loads occurring over the service life. A substantial portion of the load typically arises here due to the working load in the attachment parts, in particular valve cups. This is because it leads, for example, from the attachment parts via a main pipe of the fuel-conveying component into the retaining parts and, in some instances, further retaining elements, and then into the cylinder head. As a result, the joining sites, which may be configured, for example, as brazing points, are heavily stressed. Such joining sites exist, in particular between the retaining parts and the fuel-conveying component, as well as between the attachment parts and the fuel-conveying component. As a matter of principle, this alone may lead to very high stresses at the brazing points. The connecting parts are provided to reduce these stresses. This eliminates the need for a single-piece cast construction, which in each case includes one retaining part and one attachment part, thereby making a considerable cost savings possible. Thus, a stress-optimized design may be realized, also without a cast construction.

The assembly, respectively assemblies make possible a cost-effective and simple retainer and valve cup construction that is not configured as a cast construction. The connecting parts stiffen the respective connection between the valve cup and the retaining part, the design being implemented in such a way that stresses at bonding sites, in particular brazing points, are minimized between the valve cup and a tubular main body of the fuel-conveying component, as well as, in some instances, between the retaining part and the tubular main body, and stress peaks, respectively maxima of the mechanical stress are preferably placed in the connecting parts. They may especially be placed in bends of the connecting parts. This means that the brazed seams are relieved, and stresses are brought into the connecting parts, in particular into connecting parts formed from sheet-metal sections.

It is also possible to avoid a redundancy in determination in the installation of the connecting parts, in particular of the stiffening plates, in order that the position of the retaining parts and of the attachment parts, in particular of the valve cups, not be affected. In this case, a design may be realized where small brazing joints, that are typically smaller than 0.3 mm, may be readily achieved. Such a design is especially suited for an embodiment where the injector axes, thus the longitudinal axes of the fuel injectors, do not intersect a pipe axis, thus a longitudinal axis of a tubular main body of the fuel distributor.

It is thus possible to realize a stress-optimized design, a tolerance-optimized design and/or a cost-effective design.

At the same time, at least one retaining part and at least one attachment part may be fastened directly, thus without any further intermediate part, to a tubular main body, in particular to a main pipe of the fuel-conveying component. Here, a formed part type of construction may be advantageously used for one or a plurality of connecting parts. Such a formed part is thereby preferably not fastened to the tubular main body and also does not contact the same. A connecting part, especially a formed part, may be joined by a form-locking connection and/or frictional connection and/or material-to-material bond in each particular case, on the one hand, to the retaining part and, on the other hand, to the attachment part.

In a modified embodiment, a multipart design of the individual connecting part(s) between the retaining part and the attachment part is also possible.

A targeted design of the connecting part, in particular of the stiffening plate, allows it to be freely positioned on the attachment part, in particular a valve cup, and slid onto the retaining part. Here, a brazing gap is still freely adjustable, there being no redundancy in determination. One surface area may be used in each particular case for a connection to the retaining part and the attachment part. In addition, the profile of force flow occurring during operation between the retaining part and the attachment part may be predetermined by the embodiment of the connecting part, as well as by the selection of the particular fastening sites, respectively fastening regions. In this case, the connecting part is not directly connected to the fuel-conveying component, in particular a tubular main body of the fuel-conveying component, nor does it make contact therewith. This means that the connecting part, in particular a stiffening plate, also does not affect the position of the retaining part, nor of the attachment part.

BRIEF DESCRIPTION OF THE DRAWINGS

Preferred exemplary embodiments of the present invention are described in greater detail below with reference to the figures in which corresponding elements are provided with identical reference numerals.

DETAILED DESCRIPTION OF EXAMPLE EMBODIMENTS

Figure 1:
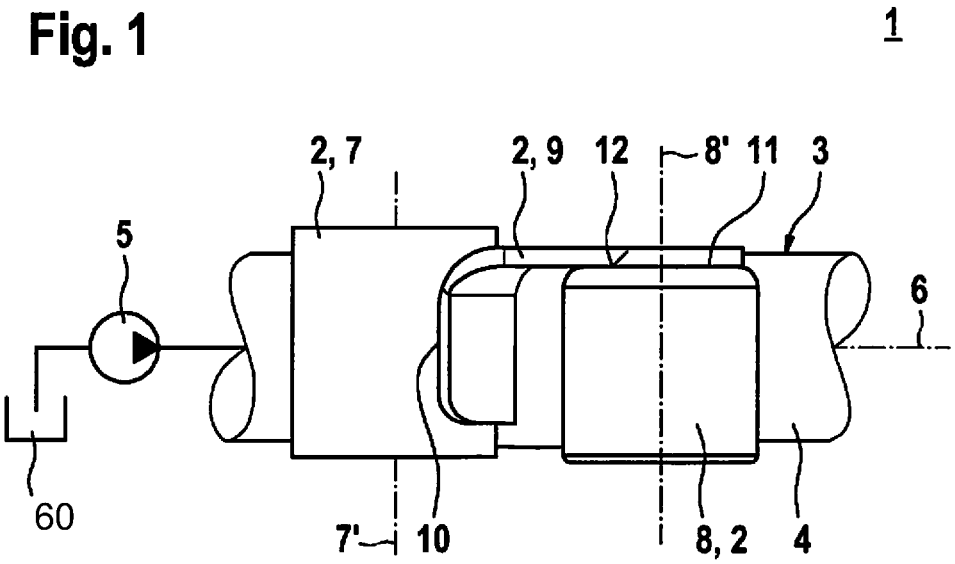
FIG. 1 schematically shows a partial view of a fuel-injection system having an assembly in accordance with a first exemplary embodiment of the present invention.

FIG. 1 schematically shows a partial view of a fuel-injection system 1 having an assembly 2 in accordance with a first exemplary embodiment of the present invention. Fuel-injection system 1 may be used in particular for high-pressure fuel injection in internal combustion engines. Fuel-injection system 1 may especially be used in mixture-compressing, spark-ignition internal combustion engines. Assembly 2 is especially suited for such a fuel-injection system 1.

In this exemplary embodiment, fuel-injection system 1 has a fuel-conveying component 3 which includes a tubular main body 4. Via at least one pump 5, fuel may be delivered from a tank 60 at a high pressure into fuel-conveying component 3. Assembly 2 is used for hydraulically and mechanically connecting a fuel injector (not shown) to fuel-conveying component 3. In the illustrated or at least in a modified embodiment, assembly 2 may be provided once or repeatedly on fuel-conveying component 3 in order to connect a corresponding number of fuel injectors to component 3.

In this exemplary embodiment, tubular main body 4 of fuel-conveying component 3 has a longitudinal axis 6. Assembly 2 has a retaining part 7, an attachment part 8, and a connecting part 9. An axis 7' of retaining part 7 does not intersect longitudinal axis 6; however, projected into the illustrated drawing plane, longitudinal axis 6 and axis 7' intersect at an angle defined here as equaling 90°. Furthermore, axis 8' of attachment part 8 and longitudinal axis 6 do not intersect; however, projected into the illustrated drawing plane, these intersecting at an angle of 90°.

Attachment part 8 is in the form of a cup 8. Retaining part 7 is fabricated of a tubular base material. Connecting part 9 is preferably made of a reshaped sheet metal piece. In this case, a planar connection 10 is provided between connecting part 9 and retaining part 7, it being possible for a material-to-material bond, in particular a brazed connection to be provided at suitable locations, respectively in suitable regions. In addition, a planar connection 11 is provided between connecting part 9 and a top side 12 of attachment part 8. Material-to-material bonds, in particular brazed connections may likewise be configured in some sites or regions.

Attachment part 8 is directly connected to tubular main body 4, for example, by brazing. In this case, a pressure-tight connection is ensured, to render possible a fuel inflow into an interior space of attachment part 8 formed as a cup 8 when the fuel injector having a connecting pipe is inserted along axis 8' into attachment part 8.

Connecting part 9 is neither connected to tubular main body 4 nor is it in contact therewith.

Retaining part 7 is used, in particular, for fastening to a cylinder head, a screw or a different fastening means being guided along axis 7' of retaining part 7. Retaining part 7 may be directly connected to tubular main body 4, for example, by brazing. However, a modified embodiment is also conceivable where retaining part 7 is not connected in a material-to-material bond to tubular main body 4 and either contacts or does not contact the same. The mechanical connection may then be at least essentially realized via connecting part 9 and attachment part 8, in order to indirectly connect retaining part 7 to tubular main body 4.

Thus, the fuel injector is hydraulically connectable to attachment part 8. Retaining part 7 is used for mechanical fastening. When retaining part 7 is connected in the assembled state, for example, to a cylinder head of an internal combustion engine, then the fuel injector inserted into attachment part 8 is mechanically fastened in this manner. This is because the fuel injector is then fastened between attachment part 8 and the cylinder head.

Figure 2:
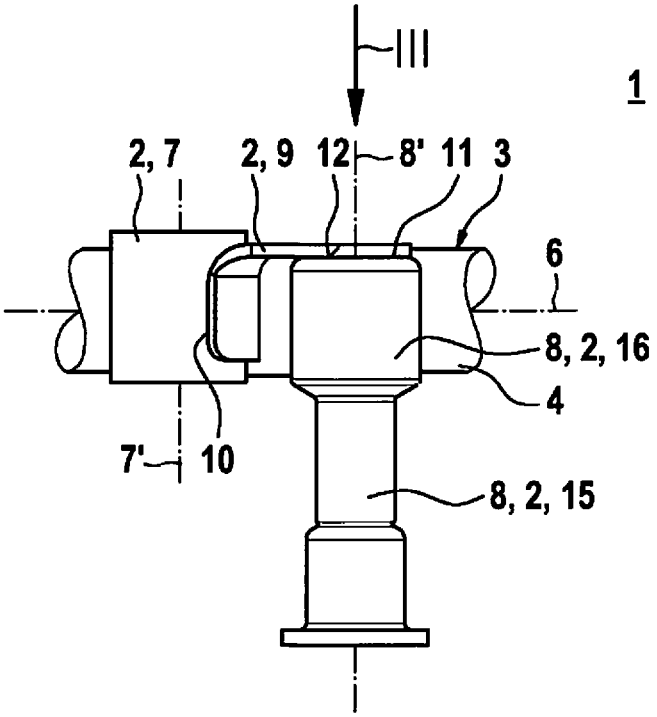
FIG. 2 shows the fuel-injection system illustrated in FIG. 1 in accordance with a second exemplary embodiment of the present invention.

FIG. 2 shows fuel-injection system 1 illustrated in FIG. 1 in accordance with a second exemplary embodiment. In this exemplary embodiment, attachment part 8 of assembly 2 is composed of a cup 15 and of an extension 16. Here, a rotationally symmetric embodiment is selected both for retaining part 7, as well as for attachment part 8.

Correspondingly, it is also possible to realize a rotationally symmetric embodiment for retaining part 7 and attachment part 8 of assembly 2 of the first exemplary embodiment.

Figure 3:
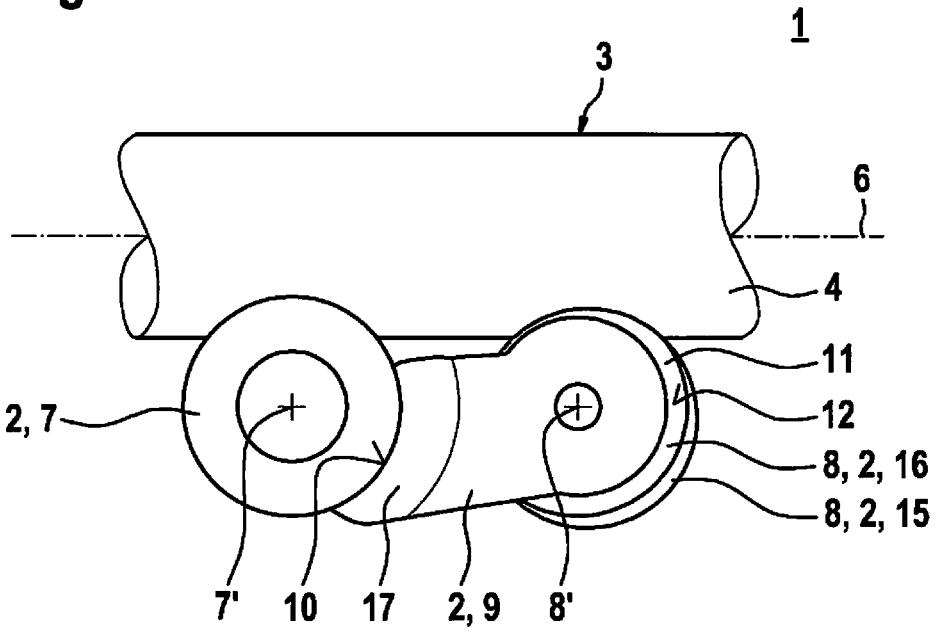
FIG. 3 shows the fuel-injection system illustrated in FIG. 2 in accordance with the second exemplary embodiment of the present invention, from the direction of view indicated by III.

FIG. 3 shows fuel-injection system 1 illustrated in FIG. 2 in accordance with the second exemplary embodiment from the direction of view indicated by III. Configured on connecting part 9 is, in particular a region 17 where connecting part 9 is curved in order to optimize stress.

Figure 4:
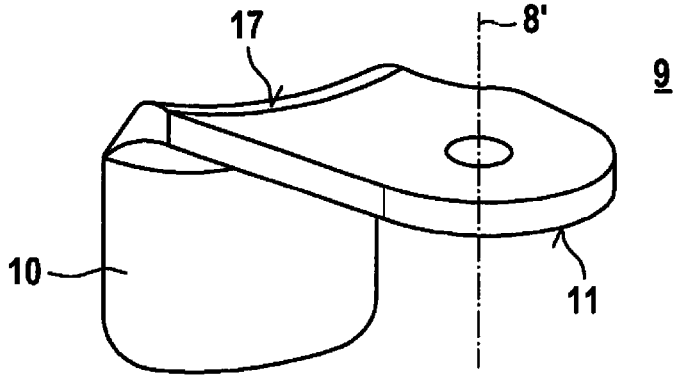
FIG. 4 shows a connecting part in a three-dimensional view in accordance with a possible embodiment of the present invention.

FIG. 4 shows a connecting part 9 in a three-dimensional view in accordance with a possible embodiment of the present invention. Here, connecting part 9 has a curved configuration to render possible connection 10 with retaining part 7. Depending on the form of top side 12 of attachment part 8, connecting part 9 may have a planar or curved shape to render possible connection 11.

Figure 5:
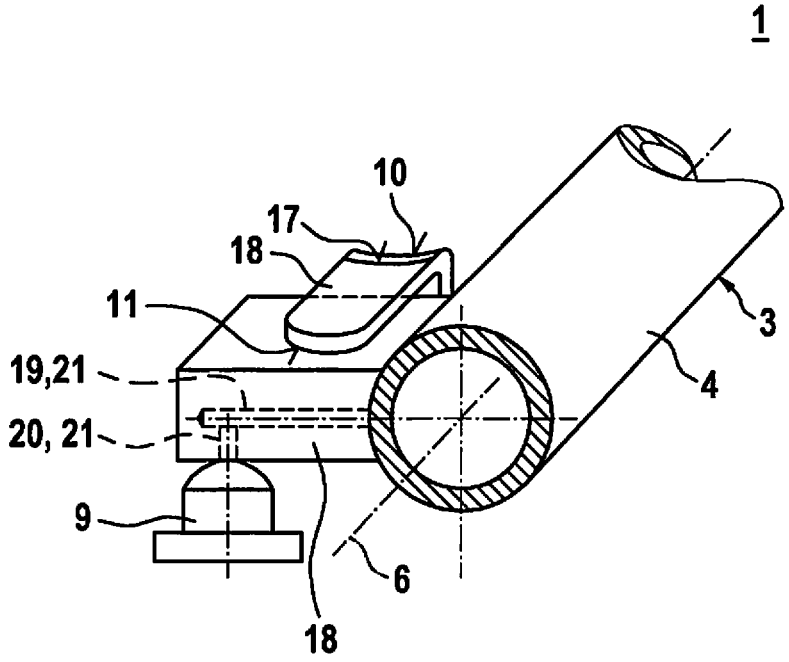
FIG. 5 schematically shows a partial, schematic view in accordance with a third exemplary embodiment of the present invention.

FIG. 5 schematically shows a partial view of a fuel-injection system 1 in accordance with a third exemplary embodiment. In this exemplary embodiment, connecting part 9 configured as a cup 9 is indirectly connected to tubular main body 4 of fuel-conveying component 3. Here, an intermediate piece 18 is provided in which a fuel channel 21 is realized that is formed by bores 19, 20 that are cut together. During operation, fuel may be conveyed to cup 9 via fuel channel 21. Connecting part 9 is suitably connected to intermediate piece 18. Attachment part 8 is thereby connected via intermediate piece 18 to connecting part 9.

A direct connection of connecting part 9 is preferably provided, on the one hand, to attachment part 8 and, on the other hand, to retaining part 7, as is described with reference to FIG. 1 through 4. However, in a modified embodiment, an indirect connection is also possible, as is also described, for example, with reference to FIG. 5.

The present invention is not limited to the exemplary embodiments described herein.

What is claimed is:

1. An assembly for a fuel-injection system for connecting a fuel injector to a fuel-conveying component, comprising:

a retaining part for mechanical fastening;

an attachment part to which the fuel injector is hydraulically connectable, wherein the attachment part includes a cup; and a connecting part via which the attachment part, that is connectable to the fuel-conveying component, is connectable to the retaining part, the connecting part including a first, vertical portion connectable to the retaining part, and a second, horizontal portion connectable to the attachment part, wherein a bottom surface of the second, horizontal portion of the connecting part is connectable to a top surface of the cup.

2. An assembly as recited in claim 1, wherein the attachment part is directly fastenable to the fuel-conveying component.

3. The assembly as recited in claim 1, wherein the retaining part is directly fastenable to the fuel-conveying component.

4. The assembly as recited in claim 1, wherein the retaining part is not connected directly to the fuel-conveying component, the retaining part being connected to the fuel-conveying component via at least the connecting part and the attachment part.

5. The assembly as recited in claim 1, wherein the retaining part is made of a rotationally symmetric bar material.

6. The assembly as recited in claim 1, wherein the connecting part is configured as a one-piece formed part.

7. The assembly as recited in claim 1, wherein the connecting part is formed as a multipiece connecting part.

8. The assembly as recited in claim 1, wherein the connecting part is formed from at least one sheet-metal section.

9. A fuel-injection system for internal combustion engines, comprising:

at least one assembly for connecting a fuel injector to a fuel-conveying component, including:

a retaining part for mechanical fastening;

an attachment part to which the fuel injector is hydraulically connectable, wherein the attachment part includes a cup, and a connecting part via which the attachment part, that is connectable to the fuel-conveying component, is connectable to the retaining part, the connecting part including a first, vertical portion connectable to the retaining part, and a second, horizontal portion connectable to the attachment part, wherein a bottom surface of the second, horizontal portion of the connecting part is connectable to a top surface of the cup, wherein the attachment part is at least indirectly connected to the fuel-conveying component, and the retaining part is connected to the attachment part via the connecting part.

10. The fuel-injection system as recited in claim 9, wherein the connecting part is not directly connected to the fuel-conveying component.

11. The fuel-injection system as recited in claim 9, wherein the connecting part does not contact the fuel-conveying component.

12. The fuel-injection system as recited in claim 9, wherein the connecting part includes a third, curved portion connecting the first, vertical portion to the second, horizontal portion.

13. The fuel-injection system as recited in claim 9, wherein the first, vertical portion is planar.

14. The fuel-injection system as recited in claim 9, wherein the second, horizontal portion is planar.

15. The fuel-injection system as recited in claim 9, wherein the bottom surface of the second, horizontal portion is curved.

16. The assembly as recited in claim 1, wherein the connecting part includes a third, curved portion connecting the first, vertical portion to the second, horizontal portion.

17. The assembly as recited in claim 1, wherein the first, vertical portion is planar.

18. The assembly as recited in claim 1, wherein the second, horizontal portion is planar.

19. The assembly as recited in claim 1, wherein the bottom surface of the second, horizontal portion is curved.

* * * * *